US005205763A

United States Patent [19]

Watanabe et al.

[11] Patent Number: 5,205,763

[45] Date of Patent: Apr. 27, 1993

[54] CONNECTOR WITH TERMINAL HOLDER

[75] Inventors: Tamio Watanabe; Masanori Tsuji; Motohisa Kashiyama; Terutoshi Satoh, all of Shizuoka, Japan

[73] Assignee: Yazaki Corporation, Tokyo, Japan

[21] Appl. No.: 854,446

[22] Filed: Mar. 19, 1992

[30] Foreign Application Priority Data

Mar. 20, 1991 [JP] Japan ..... 3-056827

[51] Int. Cl.[5] ..... H01R 13/514

[52] U.S. Cl. ..... 439/752; 439/595

[58] Field of Search ..... 439/752, 595

[56] References Cited

U.S. PATENT DOCUMENTS 4,946,399 8/1990 Kawashima ..... 439/752
5,108,319 4/1992 Tsuji et al. .....

FOREIGN PATENT DOCUMENTS 113809 7/1984 European Pat. Off.
3839014 6/1990 Fed. Rep. of Germany.
4006437 9/1990 Fed. Rep. of Germany.
50-78982 7/1975 Japan .
2230391 10/1990 United Kingdom ..... 439/752

*Primary Examiner*—Eugene F. Desmond
*Attorney, Agent, or Firm*—Sughrue, Mion, Zinn, Macpeak & Seas

[57] ABSTRACT

In this invention, metal terminals are held by a connecting member, connectable to a connector housing, so as to stabilize the posture of each metal terminal, thereby facilitating the fitting thereof with its mating metal terminal.

According to the present invention, a connector includes a connector housing for receiving metal terminals therein, and a terminal holder connected to the connector housing in a two-stage manner, that is, first in a provisionally-connected condition and then in a completely-connected condition. In the provisionally-connected condition, a flexible deformable plate of the terminal holder rests on push-up projections of the connector housing to thereby allow the insertion and withdrawal of the metal terminal relative to a terminal receiving chamber. In the completely-connected condition, a terminal holding portion on the flexible deformable plate urges and fixes the metal terminal.

7 Claims, 4 Drawing Sheets

CONNECTOR WITH TERMINAL HOLDER

BACKGROUND OF THE INVENTION

This invention relates to a connector used mainly for connecting a wire harness of an automobile, and more particularly to a connector having a terminal holder provided at a rear portion thereof.

In FIG. 8 , a connector housing a includes a hood portion $a_1$ and a terminal receiving portion $a_2$, and metal terminals c are received in terminal receiving chambers b. A retaining member d is releasably attached to the terminal receiving portion $a_2$ from the rear end thereof to cover the outer surface thereof, and this retaining member is fixed by engaging a lock arm e with a projection f.

In a condition (FIG. 9 ) in which the connector housing a and the retaining member d are connected together, projections h formed on flexible deformable plates c extend respectively through slits i into the terminal receiving chambers b to engage stepped portions of the metal terminals c, respectively, thereby preventing rearward withdrawal of these metal terminals.

In the above conventional art, the retaining of the metal terminal in the terminal receiving chamber is unstable, and the metal terminal is subjected to lateral shaking, and therefore it is difficult to properly maintain the posture of fitting of the metal terminal with its mating metal terminal. As a result, when connecting the connector housings together, the end faces of the female and male metal terminals are liable to impinge on each other, which causes withdrawal of the terminal and an imperfect contact.

SUMMARY OF THE INVENTION

With the above problem in view, the present invention is intended to stabilize the posture of metal terminals by means of a connecting member which is connected to a connector housing to hold the metal terminals.

To achieve the above object, according to the present invention, there is provided a connector with a terminal holder characterized in that the connector comprises a connector housing receiving metal terminals therein, and a terminal holder connected to said connector housing in a two-stage manner, that is, first in a provisionally-connected condition and then in a completely-connected condition; in the provisionally-connected condition, a flexible deformable plate of said terminal holder allows the insertion and withdrawal of the metal terminal, and in the completely-connected condition, a terminal holding portion on said flexible deformable plate urges and fixes the metal terminal.

In the completely connected condition, the flexible deformable plate of the terminal holder abuts against the surface of the metal terminal to urge the same, thereby preventing lateral shaking of the metal terminal.

DETAILED DESCRIPTION OF THE PREFERRED EMBODIMENTS

Figure 1:
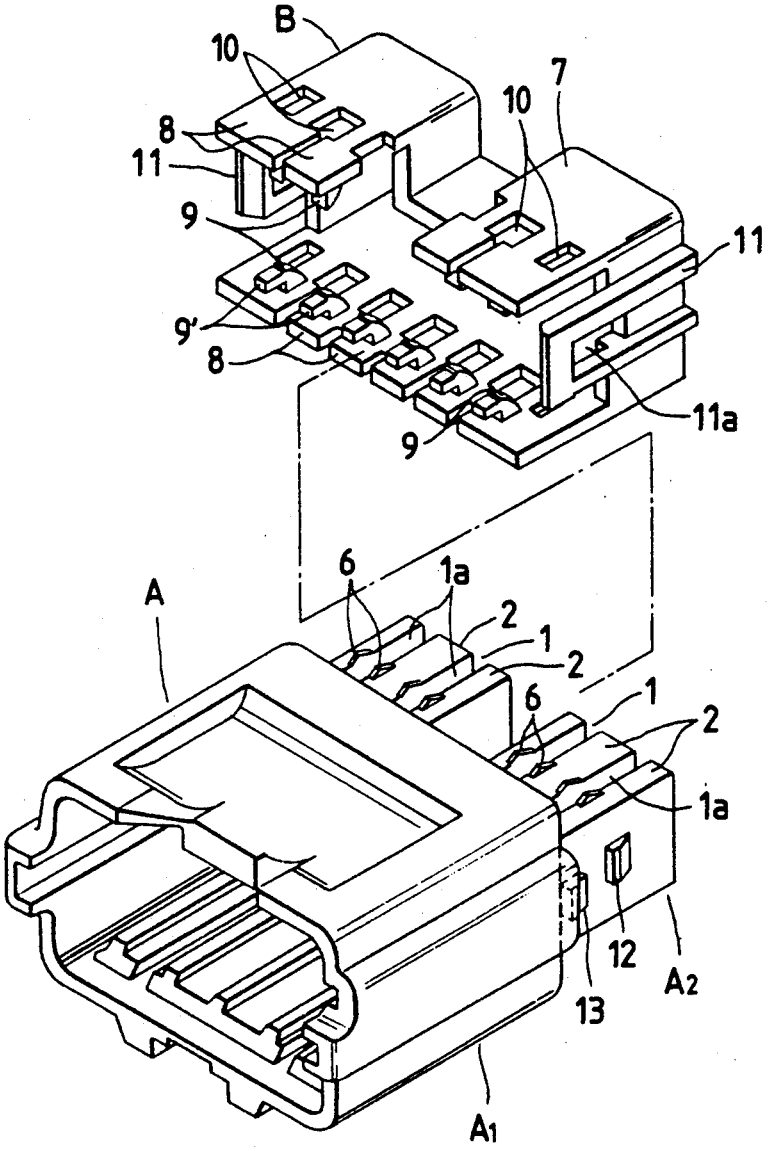
FIG. 1 is an exploded perspective view of one embodiment of the present invention.

In FIGS. 1 to 4, each of a connector housing A and a terminal holder B is integrally formed of a synthetic resin.

The connector housing A has a hood portion $A_1$ at its front half portion, and a terminal receiving chamber block $A_2$ at its rear half portion, and the peripheral wall of the connector housing is removed at the rear half portion.

Wall plates 2 and 2 are provided at opposite sides of each terminal receiving chamber 1, respectively. Between the wall plates 2 and 2, each terminal receiving chamber 1 is open rearwardly and upwardly or downwardly (the direction perpendicular to the axial direction in the drawings) as at 1*a*. Each terminal receiving chamber 1 has a flexible retaining piece 3 for a metal terminal C, and has a terminal insertion hole 5 which is provided through an intermediate partition wall 4 and is directed forwardly.

Push-up projections 6 are formed in a row on the outer surfaces of the wall plates 2, and each projection 6 has a tapered surface disposed in the forward-backward direction.

Figure 5:
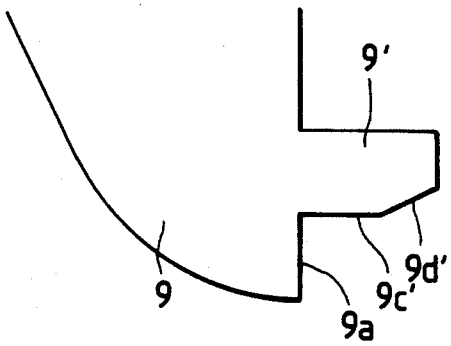
FIG. 5 is an enlarged view of an important portion of the above embodiment.

The terminal holder B has a plurality of flexible deformable plates 8 which are formed in a cantilever fashion on upper and lower portions of a main frame portion 7 in such a manner as to correspond to the terminal receiving chambers 1, the main frame portion 7 receiving the terminal receiving chamber block $A_2$. A terminal retaining projection 9 is formed on the inner surface of the flexible deformable plate 8, and a relief notch 10 is formed at that portion disposed rearwardly of the terminal retaining projection 9. A terminal holding portion 9′ extends forwardly from the terminal retaining projection 9. As shown in FIG. 5, a slanting guide surface 9*d*′ is formed on the lower side of the terminal holding portion 9′ at the front end thereof so as to prevent this terminal holding portion from impinging on an intermediate box-like portion 14 of the metal terminal C. Formed continuous with this slanting guide surface are a terminal urging surface 9*c*′ and a terminal retaining surface 9*a*. When the terminal holder B is to be connected to the connector housing A, the flexible deformable plate 8 slides over the opposed wall plates 2 and 2 forming the terminal receiving chamber 1, and the terminal retaining projection 9 and the terminal holding portion 9′ are projected into the terminal receiving chamber 1.

Housing retaining arms 11 each having a retaining hole 11*a* are formed respectively on the opposite sides of the main frame portion 7 of the terminal holder B in a forwardly-projecting manner. A provisionally-retaining projection 12 and a completely-retaining projection 13 are formed on each of the opposite outer wall plates 2 of the connector housing A, the projection 12 and the projection 13 being arranged in this order from the rear side to the front side of the connector housing, and being engageable with the housing retaining arm 11.

Figure 2:
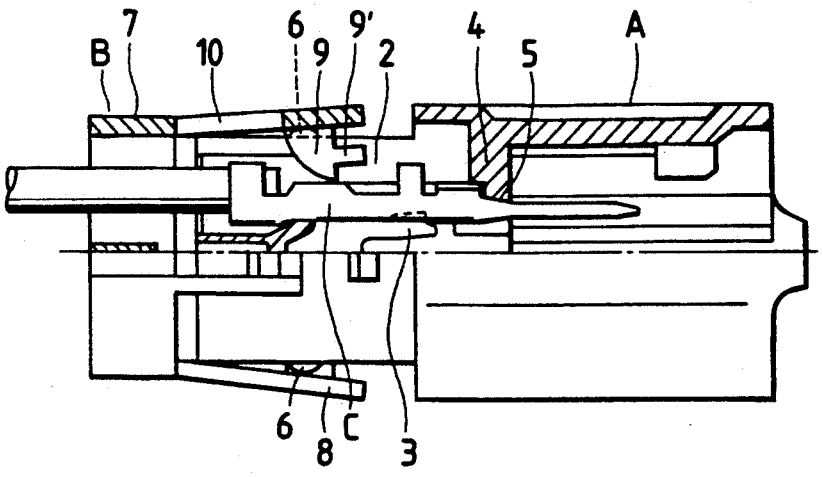
FIG. 2 is a cross-sectional view of the above embodiment in a provisionally-connected condition.

FIG. 2 is a cross-sectional view showing a provisionally-connected condition in which the housing retaining arms 11 of the terminal holder B are engaged with the provisionally-retaining projections 12 of the connector housing A, respectively. In this case, each flexible deformable plate 8 rests on the push-up projections 6, so that the terminal retaining projection 9 and the terminal holding portion 9' are disposed out of the path of insertion of the metal terminal C within the terminal receiving chamber 1, and therefore the metal terminal 1 is smoothly inserted, and is retained by the flexible retaining piece 3.

Figure 3:
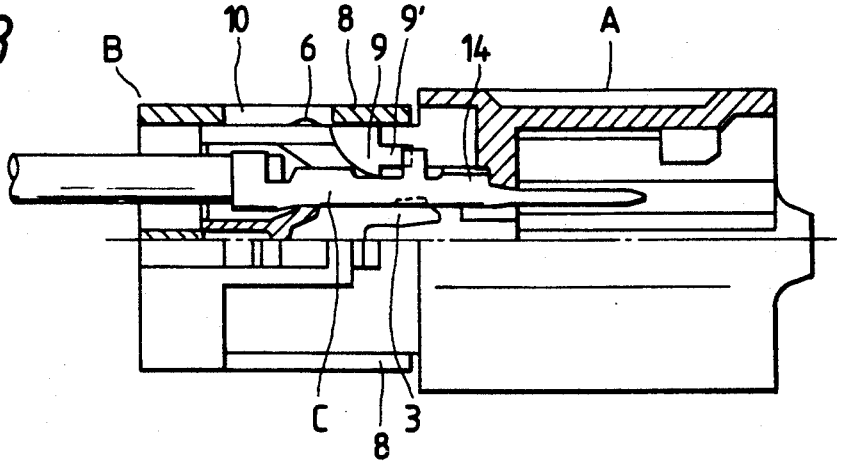
FIG. 3 is a cross-sectional view of the above embodiment in the process of shifting to a completely-connected condition.
Figure 4:
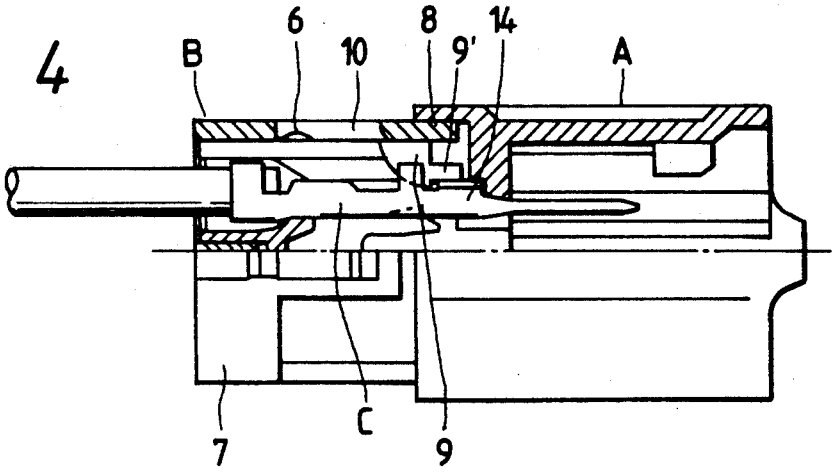
FIG. 4 is a cross-sectional view of the above embodiment in the completely-connected condition.

In this condition, when the terminal holder B is further pushed slightly, the push-up projections 6 are received in the relief notches 10, so that each flexible deformable plate 8 restores to bring the terminal retaining projection 9 and the terminal holding portion 9' deep into the terminal receiving chamber 1 (FIG. 3). When the terminal holder B is further pushed, the housing retaining arms 11 are engaged respectively with the completely-retaining projections 13, thereby achieving the completely-connected condition. In this case, the terminal retaining projection 9 is positioned at the rear of the intermediate box-like portion 14 of the metal terminal C, thereby retaining the metal terminal C in a double manner, and at the same time the terminal holding portion 9' rests on the intermediate box-like portion 14 of the metal terminal C to urge the same under the resiliency of the flexible deformable plate 8, thereby fixing the metal terminal C (FIG. 4).

Figure 7:
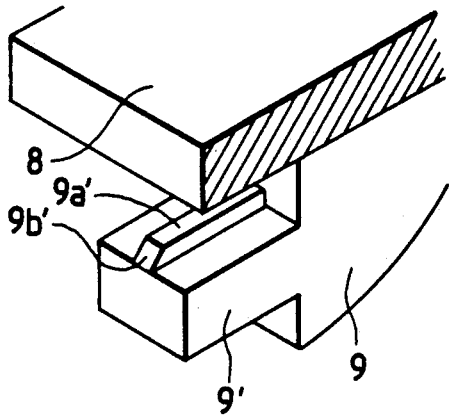
FIG. 7 is an enlarged perspective view of an important portion of the modified construction.
Figure 6:
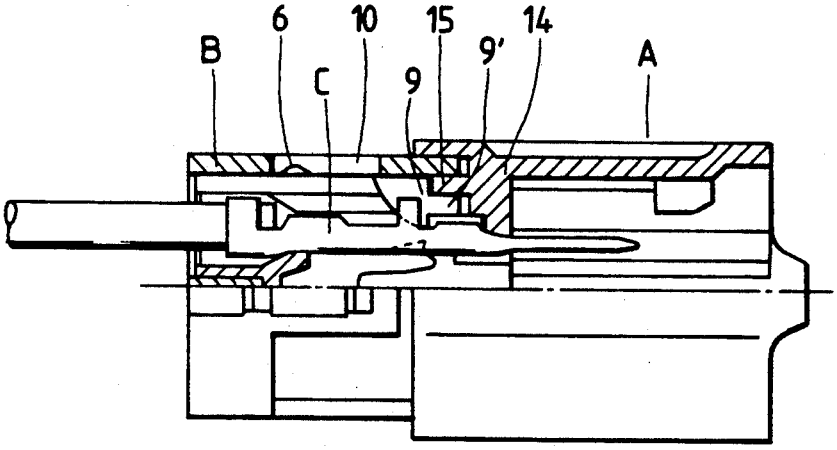
FIG. 6 is a cross-sectional view of a modified construction in a completely-connected condition.
Figure 8:
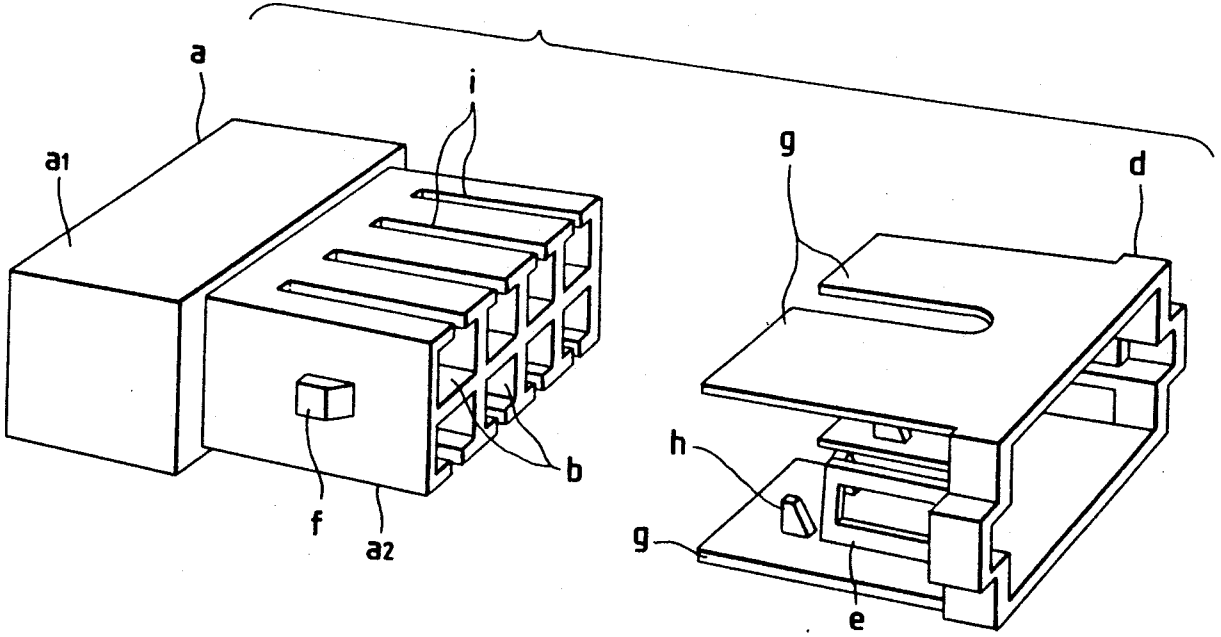
FIG. 8 is an exploded perspective view of a conventional construction.
Figure 9:
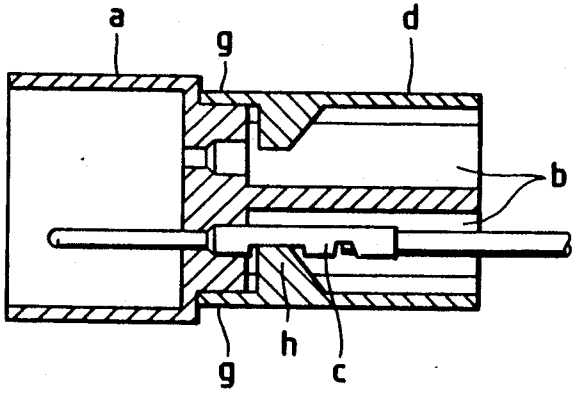
FIG. 9 is a cross-sectional view of the conventional construction in a connected condition.

FIG. 6 shows a complete-connection condition of another construction, and in this case a terminal holding portion 9' is press-fitted between an engaging wall 15 of a connector housing A and the intermediate box-like portion 14 of the metal terminal C, thereby fixing the metal terminal C. As shown in FIG. 7, an elongate push projection 9a', having a slanting guide surface 9b' at its front end, is formed on that surface of the terminal holding portion 9' facing the engaging wall 15, and with this arrangement, the press-fitting is facilitated.

As described above, in the present invention, the connector comprises the connector housing receiving the metal terminals therein, and the terminal holder connected to the connector housing in a two-stage manner, that is, first in the provisionally-connected condition and then in the completely-connected condition, and in the provisionally-connected condition, the flexible deformable plate of the terminal holder allows the insertion and withdrawal of the metal terminal, and in the completely-connected condition, the terminal holding portion on the flexible deformable plate urges and fixes the metal terminal. Therefore, in the provisionally-connected condition of the terminal holder, the metal terminal can be easily inserted into the terminal receiving chamber of the connector housing, and then the terminal holder is moved into the completely-connected condition to immediately fix the metal terminals, thereby stabilizing the fitting posture of the metal terminal.

What is claimed is:

1. A connector comprising:

a plurality of metal terminals;

a connector housing for receiving said metal terminals; and a terminal holder movably engaged with said connector housing in two steps, provisionally and completely, said terminal holder including a plurality of flexible, deformable plates each of which has a terminal retaining member, wherein said connector housing is provided with a plurality of projection members corresponding to said flexible, deformable plates, and wherein said flexible, deformable plates abut and are directed outwardly by said projection members so as to permit insertion and withdrawl of said metal terminals in the provisionally-connected condition, and wherein said terminal retaining member urges and fixes said metal terminal in eh completely-connected condition.

2. A connector comprising:

a plurality of metal terminals;

a connector housing including a plurality of terminal receiving chambers each of which is defined by a pair of opposite wall plates, each of said wall plates having a push-up projection; and a terminal holder movably engaged with said connector housing in two steps, provisionally and completely, said terminal holder having a plurality of flexible deformable plates corresponding to said terminal receiving chambers, each of said flexible deformable plates having a terminal retaining projection, wherein when said terminal holder is provisionally engaged with said connector housing, each of said push-up projections is pushingly abutted against said flexible deformable plate so that said metal terminal is smoothly inserted and is retained within said terminal receiving chamber, and when said terminal holder is completely engaged with said connector housing, said metal terminal is urged by said terminal retaining projection.

3. A connector according to claim 2, each of said metal terminals having an insertion path; and said terminal holder having a plurality of relief notches, wherein when said terminal holder is provisionally engaged with said connector housing, each of said terminal retaining projections is disposed out of said insertion path, and when said terminal holder is completely engaged with said connector housing, each of said push-up projections is engaged with said relief notch so that each of said flexible deformable plate restores to bring said terminal retaining projections deep into said terminal receiving chamber.

4. A connector according to claim 2, each of said metal terminals having a box-like member at an intermediate portion thereof, wherein. when said terminal holder is completely engaged with said connector housing, each of said terminal retaining projections is disposed at a rear of said box-like member.

5. A connector according to claim 4, wherein a terminal holding projection is extended from each of said terminal retaining projections and, when said terminal holder is completely engaged with said connector housing, said terminal retaining projection rests on said box-like member so that said box-like member is urged by said flexible deformable plate through said terminal retaining projection, thereby fixing said metal terminal.

6. A connector according to claim 4, wherein a terminal holding projection is extended form each of said terminal retaining projections; said connector housing including an engagement wall therein; said terminal holding projection being press-fitted between said engagement wall and said box-like member when said terminal holder is completely engaged with said connector housing.

7. A connector according to claim 6, wherein said terminal holder projection includes an elongate push projection formed on a surface of said terminal holding projection facing said engagement wall, nd wherein said engagement wall includes a corresponding groove for accepting said elongate push projection.

* * * * *